US007070643B2

(12) United States Patent
Kobayashi

(10) Patent No.: US 7,070,643 B2
(45) Date of Patent: Jul. 4, 2006

(54) COMPOSITIONALLY GRADED SINTERED ALLOY AND METHOD OF PRODUCING THE SAME

(75) Inventor: Masaki Kobayashi, Kawasaki (JP)

(73) Assignee: Toshiba Tungaloy Co., Ltd., Kawasaki (JP)

( * ) Notice: Subject to any disclaimer, the term of this patent is extended or adjusted under 35 U.S.C. 154(b) by 0 days.

(21) Appl. No.: 10/809,469

(22) Filed: Mar. 26, 2004

(65) Prior Publication Data

US 2004/0187639 A1 Sep. 30, 2004

(30) Foreign Application Priority Data

Mar. 27, 2003 (JP) ..... 2003-087973

(51) Int. Cl.
*C22C 29/02* (2006.01)
*C22C 29/16* (2006.01)

(52) U.S. Cl. ..... 75/239; 75/240; 75/242; 428/547; 428/545

(58) Field of Classification Search ..... 75/239, 75/240, 244, 242; 428/545, 547
See application file for complete search history.

(56) References Cited

U.S. PATENT DOCUMENTS

| | | | |
|---|---|---|---|
| 6,190,762 B1 | 2/2001 | Rödiger et al. | |
| 6,589,602 B1 * | 7/2003 | Kobayashi et al. | 427/404 |

FOREIGN PATENT DOCUMENTS

| | | | |
|---|---|---|---|
| JP | 2-15139 A | | 1/1990 |
| JP | 2-93036 A | | 4/1990 |
| JP | 2-209448 A | | 8/1990 |
| JP | 2-209499 A | | 8/1990 |
| JP | 4-128330 A | | 4/1992 |
| JP | 4-187739 A | | 7/1992 |
| JP | 7-138691 A | | 5/1995 |
| JP | 2000-503344 A | | 3/2000 |
| JP | 2001-81526 A | | 3/2001 |
| RU | 2164260 | * | 3/2001 |

* cited by examiner

*Primary Examiner*—Ngoclan T. Mai
(74) *Attorney, Agent, or Firm*—Foley & Lardner LLP

(57) ABSTRACT

There is disclosed a compositionally graded sintered alloy which comprises: 1 to 40% by weight of a iron group metal; 0.1 to 10% by weight of at least one type of a specific metal element selected from the group consisting of Cr, Au, Ge, Cu; Sn, Al, Ga, Ag, In, Mn and Pb; a hard phase containing, as a main component, at least one compound selected from the group consisting of a carbide, a nitride and a mutual solid solution of a metal(s) which belongs to Group 4 (Ti, Zr, Hf), 5 (V, Nb, Ta) or 6 (Cr, Mo, W) of the Periodic Table; and inevitable impurities, wherein the content of the specific metal element gradually increases from a surface of the sintered alloy toward an inner portion thereof, and a ratio of the average concentration of the specific metal element in a region which is at least 1 mm inside from the surface of the sintered alloy, to the average concentration of the specific metal element in a region between the surface and the position which is 0.1 mm inside the surface, of the sintered alloy, is 1.3 or more.

9 Claims, No Drawings

COMPOSITIONALLY GRADED SINTERED ALLOY AND METHOD OF PRODUCING THE SAME

BACKGROUND OF THE INVENTION

1. Field of the Invention

The present invention relates to a compositionally graded sintered alloy and a method of producing the same, which sintered alloy is very suitable for cemented carbide, cermet, and substrate of coated sintered alloy produced by coating cemented carbide or cermet with a hard film, used for tools of various types represented by a cutting tool such as insert chip, drill and end mill, a wear-resistant tool such as die, punch and slitter, and a construction tool such as cutter bit.

2. Description of the Related Art

A hard sintered alloy such as a cemented carbide represented by WC—Co based alloy and WC—(W, Ti, Ta) C—Co based alloy and a cermet represented by TiC—Fe and Ti(C,N)—WC—TaC—Ni obtains alloy characteristics required in each of the applications of cutting tool or member, wear resistant tool or member and the like, which alloy characteristics includes hardness, strength, toughness, wear resistance, breaking resistance and chipping resistance, by adjusting the grain size of a carbide hard phase, the amount of a metal binder phase, and the amount to be added of other carbides (VC, $Cr_3C_2$, $Mo_2C$, ZrC and the like) and thereby achieving performance required in use. However, hardness and toughness (or wear resistance and breaking resistance) are alloy characteristics which are incompatible with each other and it is very difficult to improve such two incompatible characteristics at the same time. As one example of a method of improving hardness and toughness at the same time, there has been proposed a method of reinforcing a binder phase of an alloy by adding Cr, Mo, Al, Si, Mn and the like (e.g., Japanese Patent Application Laid-Open (JP-A) No. 7-138691, Japanese PCT Patent Application Laid-Open 2000-503344 and JP-A 2001-81526). Further, there has also been proposed a method of changing the amount of binder phase, the amount of added carbide and the grain size of WC between a surface of a sintered alloy and an inner portion of the sintered alloy, thereby producing a compositionally graded structure in which a vicinity of an alloy surface has relatively high hardness and high wear resistance (or relatively high strength and high toughness) (e.g., JP-A 2-209448, JP-A 2-209499, JP-A 2-15139, JP-A 2-93036, JP-A 4-128330 and JP-A 4-187739). The method of producing a compositionally graded alloy aims at strengthening a region in the vicinity of an alloy surface which is to function as a tip of a tool blade, and thus is a reasonable and effective method.

As a method of improving the aforementioned alloy characteristics by adding a substance, JP-A 7-138691 discloses a cemented carbide for processing aluminum, comprising 5 to 35% by weight of Cr with respect to the amount of a metal binder phase, wherein the amount of the binder phase is 4 to 25% by weight of the weight of the alloy and the remainder is WC whose average particle diameter is 1 to 10 μm. Further, Japanese PCT Patent Application Laid-Open 2000-503344 discloses a cemented carbide as a minute composite material containing 3 to 30% by weight of a binder metal obtained by a sintering reaction effected in a micro wave region, which material further contains 0.01 to 5% by weight of Mo, Mn, Al, Si and Cu and in which the metal binder phase is comprised of Ni and Cr. Yet further, JP-A 2001-81526 discloses an iron-based cemented carbide comprising Fe whose binder phase comprises 0.35 to 3.0% by weight of C; 3.0 to 30.0% by weight of Mn and 3.0 to 25.0% by weight of Cr.

In each of the cemented carbides disclosed in the above-described three references, a good effect of improving the alloy characteristics as described above is not likely to be obtained because the content of a binder phase thereof is relatively low, although the binder phase thereof is strengthened due to addition of metals. Further, as these cemented carbides are basically alloys each having an even or non-graded composition (between a surface and an inner portion of an alloy), there still arises a problem in that the cemented carbides cannot improve hardness and toughness at the same time in a satisfactory manner.

On the other hand, as a method of improving the above-described alloy characteristics by a graded composition, JP-A 2-209448 and JP-A 2-209499 each disclose a cemented carbide having a surface region formed such that the content of a binder phase therein is lower than the content of a binder phase in an inner portion of the alloy or the cemented carbide. The cemented carbides disclosed in these two references achieve relatively high hardness due to a decrease in the content of a binder phase in the surface region but suffers from a decrease in toughness. Therefore, the cemented carbides still cannot improve hardness and toughness at the same time in a satisfactory manner. Further, in these cemented carbides, there arises another problem in that it is difficult to significantly reduce the content of a binder phase in a surface region thereof to make the content distribution of the binder phase graded.

Further, JP-A 2-15139 and JP-A 2-93036 each disclose a TiCN-based cermet in which a hard phase in the vicinity of a surface thereof is subjected to nitriding caused by sintering at a $N_2$ partial pressure which is being adjusted, so that the content of a binder phase is decreased and the surface portion has higher toughness and hardness than an inner portion of the cermet. However, in the TiCN-based cermets of the above-described two references, although the wear resistance at the surface portions thereof are improved, the breaking-resistance thereof are not improved in a satisfactory manner. Thus, there arises a problem in that industrial fields to which these TiCN-based cermets are applicable are significantly restricted.

JP-A 4-128330 and JP-A 4-187739 disclose a cemented carbide and a cermet, respectively, in each of which, in a surface layer ranging from a surface to 0.2 to 10 mm inner side thereof, the content of at least one type of diffusion element selected from the group consisting of Cr, Mo, V, Ta, Al, Zr, Nb, Hf, W, Si, B, P and C gradually decreases from the surface toward an inner portion and the content of a binder phase or the particle diameter of a hard phase gradually increases from the surface toward the inner portion. In each of the cemented carbide and the cermet disclosed in the above-described two references, a region in the vicinity of a surface thereof has high hardness and good wear resistance due to a decrease in the content of a binder phase or the particle size of a hard phase being made fine, and also has high toughness, good breaking resistance and good plastic deformation resistance due to an effect in which a binder phase is made tougher, which effect is resulted from the presence of the above-described diffusion elements. However, the aforementioned cemented carbide and the cermet has a problem in that industrial fields to which these cemented carbide and the cerment are applicable are significantly restricted depending on the type of the diffusion element present at the surface layer.

SUMMARY OF THE INVENTION

The present invention solves the problems as described above. Specifically, one object of the present invention is to provide a compositionally graded sintered alloy and a method of producing the same, which sintered alloy is a compositionally graded material in which at least one type of specific metal element selected from the group consisting of Cr, Au, Ge, Cu, Sn, Al, Ga, Ag, In, Mn and Pb is added and sintering is carried out in a controlled atmosphere so that a content of the specific metal element is gradually increased from a surface of the sintered alloy toward an inner portion thereof, whereby the sintered alloy as a whole, including a region in the vicinity of a surface thereof, has significantly high hardness and high toughness, allowing a significant improvement of performance in use and a significant increase in the number of fields to which the sintered alloy is applicable.

The inventor of the present invention has keenly studied a possibility of simultaneously improving hardness and toughness (or wear resistance and the breaking resistance) of the conventional hard sintered alloy containing additives and having a graded composition as described above, and discovered that: hardness and toughness of a hard sintered alloy are both significantly improved by addition of a specific metal element; hardness and toughness of a hard sintered alloy are both significantly improved when the composition of the sintered alloy material is graded such that the specific metal element remains by a relatively large amount in an inner portion of the alloy (in other words, by a relatively small amount in a region in the vicinity of a surface thereof); the aforementioned specific metal element should have a boiling point lower than that of a metal which belongs to the iron group; hardness of a region in the vicinity of a surface is enhanced due to the above-described graded composition, primarily because the graded composition makes formation of a metal binder phase in the region poor; toughness of a region in the vicinity of a surface is enhanced due to the above-described graded composition, primarily because the graded composition results in a compression stress, derived from a difference in the content of metal binder phase between the surface portion and an inner portion; and the above-described compositionally graded material is obtained by first suppressing evaporation of the specific metal element during the sintering process such that a compositionally even or non-graded state of the specific metal element is achieved and then allowing the specific metal element to evaporate from the alloy surface in high vacuum. The present invention has been achieved on the basis of the aforementioned discoveries.

Specifically, a compositionally graded sintered alloy of the present invention, comprises: 1 to 40% by weight of an iron group metal; 0.1 to 10% by weight of at least specific metal element selected from the group consisting of Cr, Au, Ge, Cu, Sn, Al, Ga, Ag, In, Mn and Pb; a hard phase containing, as a main component, at least one compound selected from the group consisting of a carbide, a nitride and a mutual solid solution of a metal(s) which belongs to Group 4 (Ti, Zr, Hf), 5 (V, Nb, Ta) or 6 (Cr, Mo, W) of the Periodic Table; and inevitable impurities, wherein the content of the specific metal element gradually increases from a surface of the sintered alloy toward an inner portion-thereof, and a ratio of the average concentration (Cai) of the specific metal element in a region which is at least 1 mm inside from the surface of the sintered alloy, to the average concentration (Cas) of the specific metal element in a region between the surface and the position which is 0.1 mm inside the surface, of the sintered alloy, is 1.3 or more (Cai/Cas≧1.3).

DESCRIPTION OF THE PREFERRED EMBODIMENTS

The specific metal element contained in the sintered alloy of the present invention is at least one metal element selected from the group consisting of Cr, Au, Ge, Cu, Sn, Al, Ga, Ag, In, Mn and Pb, each of which exhibits a higher vapor pressure than that of an iron group metal at a high temperature. For example, the vapor pressure at 1423° C. which is about the sintering temperature is: approximately 0.26 Pa in Co and Ni, which are iron group metals; approximately 0.66 Pa in Fe; while approximately 2.6 Pa in Cr, Au and Ge; approximately 130 Pa in Cu; approximately 20 Pa in Sn; approximately 26 Pa in Al; approximately 93 Pa in Ga; approximately 400 Pa in Ag; approximately 1 kPa in In; approximately 1.3 kPa in Mn; and approximately 13 kPa in Pb. Although a large number of metal elements other than the above-described metals each has a vapor pressure higher than a corresponding vapor pressure of an iron group metal, the vapor pressure of such metal elements, e.g., Bi, Zn, Cd, Pd, Sb and Mg is generally so high that control of a graded composition thereof cannot be effected. Further, although a large number of rare earth metal element and Be each has a vapor pressure in substantially the same range as that of the specific metal element of the present invention, such rare earth metal elements and Be are so active that an oxide thereof are formed, whereby it is difficult for these elements to be evaporated as a metal.

When the content of the specific metal element is less than 0.1% by weight, the compositional grading resulted from by evaporation of the specific metal element during the sintering process is not effected in a sufficient manner, whereby an effect of improving hardness and toughness deteriorates. When the content of the specific metal element exceeds 10% by weight, the characteristics of the sintered alloy as a whole deteriorate due to a softened binder phase (Au, Cu, Ga, Ag, In, Pb), a brittle binder phase (Ge, Sn, Al) or generation of a carbide (Cr, Mn).

Therefore, the content of the specific metal element is to be set in a range of 0.1 to 10% by weight.

In the present invention, the content of the specific metal element gradually increases from a surface toward an inner portion of the sintered alloy. The distribution of concentration of the specific metal element, from a surface toward an inner portion of the sintered body, can be changed in a various manner by controlling the temperature at which the sintered body is held after sintering and the pressure of an atmosphere in which the sintered body is placed. It should be noted that, if a difference in concentration of a predetermined magnitude or more is not created between a surface and an inner position of the sintered body distanced by a predetermined distance, a good effect of simultaneously improving hardness and toughness, which results from the compositional grading, may not be obtained in a satisfactory manner. Specifically, a ratio of the average concentration (Cai) of the specific metal element in a region which is at least 1 mm inside from the surface of the sintered alloy, to the average concentration (Cas) of the specific metal element in a region between the surface and the position which is 0.1 mm inside the surface, of the sintered alloy, is to be 1.3 or more (i.e., Cai/Cas≧1.3). When the concentration ratio Cai/Cas is smaller than 1.3, the compositional grading of the specific metal element is insufficient, whereby an effect of simultaneously improving hardness and toughness may not be obtained in a satisfactory manner. The concentration ratio (Cai/Cas) is preferably in a range of 2 to 20. It is acceptable that Cas is substantially zero and thus Cai/Cas is substantially infinite.

The iron group metal contained in the compositionally graded sintered alloy of the present invention is at least one type of element selected from the group consisting of Co, Ni and Fe, and forms an alloy together with the specific metal element and some of Group 4, 5 and 6 metals, to form a binder phase. Specific examples of the binder phase include alloys such as Co—Cr, Co—Au, Co—Cu—W, Co—Sn—Mo, Co—Ag—W, Ni—Cr—Mo, Ni—Al, Ni—Ge—Cr, Fe—Mn and Fe—Mn—In, in each of which 20% by weight or less of W, Cr, Mo and the like are solid-dissolved.

The above-described iron group metal is a main component of a binder phase. As a result, when the content of the iron group metal is less than 1% by weight, sintering is not effected in a satisfactory manner and all of hardness, strength and toughness will deteriorate. When the content of the iron group metal exceeds 40% by weight, hardness and wear resistance will significantly be deteriorated. Thus, the content of the iron group metal is to be set in a range of 1 to 40% by weight.

Further, it is preferred that the content of the iron group metal of the sintered alloy of the present invention gradually increases from a surface toward an inner portion of the sintered alloy because such a change in the distribution of the content of the iron group metal further facilitates the compositional grading of the sintered alloy, of the present invention. The distribution of concentration of the iron group metal, observed from a surface of the sintered body toward an inner portion thereof, would remain constant if the iron group metal were to fail to be evaporated from the surface during the sintering process. The iron group metal, however, can be made to evaporate by maintaining the pressure of the atmosphere at a level no higher than the vapor pressure of the iron group metal. The iron group metal can be made to evaporate, even when the pressure of the atmosphere is at the vapor pressure of the iron group metal or higher, by the azeotropic-point-effect (i.e., an increase in the vapor pressure) caused by the addition of the specific metal element. Specifically, regarding the distribution of concentration of the iron group metal, it is preferred that a ratio of the average concentration (Cbi) of the iron group metal in a region which is at least 1 mm inside from the surface of the sintered alloy, to the average concentration (Cbs) of the same iron group metal in a region between the surface and the position which is 0.1 mm inside the surface, of the sintered alloy, is 1.1 or more ($Cbi/Cbs \geqq 1.1$) because such a graded composition of the iron group metal as described above brings a synergistic effect together with a graded composition of the specific metal element. Cbs is preferably 1% by weight or more.

With regards to the relationship between the content of the specific metal element and the content of the iron group metal in the sintered alloy of the present invention, when the content of the specific metal element is less than 5% by weight with respect to the content of the iron group metal, the synergistic effect brought by the graded composition of the specific metal and that of the iron group metal will not be obtained in a satisfactory manner. When the content of the specific metal element exceeds 50% by weight with respect to the content of the iron group metal, there arises a problem in that deformation of the alloy or generation of pores in the alloy occurs due to rapid evaporation of a relatively large amount of the specific metal element. Accordingly, it is preferred that the content of the specific metal element with respect to the content of the iron group metal is in a range of 5 to 50% by weight. With regards to the types of the specific metal element and the iron group metal which can be preferably combined, Cr, for example, brings a good effect when combined with any element selected from the group consisting of Co, Ni and Fe. In the case of Ge or Al, the element is preferably combined with Ni. In the case of Cu or Mn, the element is preferably combined with Fe.

It is preferred, in practical terms, that a hard phase of the compositionally graded sintered alloy of the present invention is tungsten carbide, or tungsten carbide and a cubic system compound comprising at least one compound selected from a carbide, a nitride and a mutual solid solution of a metal which belongs to Group 4, 5 or 6 of the Periodic Table. Specific examples of the cubic system compound include VC, TaC, NbC, TiN, HfN, (W, Ti)C, (W, Ti, Ta)C, (W, Ti, Ta) (C, N) and (Ti, W, Mo) (C, N). A portion of the hard phase may be composed of $Cr_7C_3$, $Mo_2C$ and the like, which are not cubic system compounds.

It is preferred, in practical terms, that the hard phase of the sintered alloy of the present invention contains: 30% by weight or more of at least one type of compound selected from the group consisting of a carbide, a nitride and a carbonitride of titanium; and the remainder as at least one type of compound selected from the group consisting of a carbide, a nitride and a carbonitride of a metal other than titanium, which metal belongs to Group 4, 5 or 6 of the Periodic Table. Specific examples of the hard phase include a hard phase of a structure having a core, in which structure a core portion made of titanium carbonitride is surrounded with a solid solution of carbonitride composed of Ti and at least one type of element selected from the group consisting of Mo, V, Ta, Nb and W. In the case of a sintered alloy containing nitrogen, sintering in vacuum causes denitrification from a surface of the alloy, whereby formation of a binder phase in the alloy is made poor (i.e., compositional grading due to denitrification occurs). In this case, the compositional grading due to denitrification may be utilized together with the compositional grading due to the specific metal element of the present invention.

Although the compositionally graded sintered alloy of the present invention can basically be produced by applying the conventional method of powder metallurgy, the compositional grading of the present invention will be easily optimized by employing the following method.

Specifically, a method of producing the compositionally graded sintered alloy of the present invention includes the steps of: (1) obtaining mixed powder by pulverizingly mixing 1 to 40% by weight of powder of an iron group metal, 0.1 to 10% by weight of powder of a specific metal element as at least one type of element selected from the group consisting of Cr, Au, Ge, Cu, Sn, Al, Ga, Ag, In, Mn and Pb, and powder for forming a hard phase, as a remainder, comprising at least one compound selected from the group consisting of a carbide, a nitride and a mutual solid solution of a metal(s) which belongs to Group 4, 5 or 6 of the Periodic Table; (2) molding the mixed powder into a predetermined shape, thereby obtaining a green compact; (3) holding the green compact in an inactive atmosphere of which pressure is kept no lower than the vapor pressure of the specific metal element and heating the green compact therein to 1250 to 1550° C., thereby effecting sintering; and (4) in a temperature range between the temperature at which the powdery mold has been held and heated and the temperature at which the liquid phase begins to solidify, changing the state of the inactive atmosphere to a state in which the pressure of the inactive atmosphere is no higher than the vapor pressure of the specific metal element (specifically, to a high vacuum state).

Examples of alternative powder which can be used in place of the aforementioned metal powders in the step (1) of the above-described method of the present invention include an alloy or an intermetallic compound composed of an iron group metal and a specific metal element such as Co—Cu, $Ni_3Al$, Fe—Mn and the like, and a carbide or an oxide of the specific metal element such as $Cr_3C_2$, $Al_4C_3$, CuO, $SnO_2$ and $In_2O_3$. Use of the aforementioned alternative powders by amounts which corresponds to the required amount of the specific metal element and the iron group metal is preferable in terms of homogeneous mixing, anti-oxidization, improvement of sintering properties on the like.

The step (3) of the method of the present invention is somewhat similar to the conventional sintering process carried out in vacuum or a non-oxidizing atmosphere. However, the step (3) is a unique process in which evaporation of the specific metal element from a surface of the sintered alloy is suppressed at least for a period during which the green compact is held at the predetermined sintering temperature, by introduction of an inactive gas of which pressure is kept no lower than the vapor pressure of the specific metal element which has been added, so that the composition of the sintered alloy is made even (non-graded) for a time being. The heating atmosphere may actually be a vacuum of which pressure is lower than the vapor pressure of the specific metal element, until the temperature of the heating atmosphere reaches the sintering temperature. However, in this case, if a specific metal element having a relatively high vapor pressure has been added to the alloy, it is necessary to introduce an inactive gas at some stage during the heating process. Examples of the inactive gas to be introduced include Ar and He. $N_2$ or CO may be mixed thereto, depending on the composition of the sintered alloy.

The sintering temperature in the step (3) of the method of the present invention is set-in arrange of temperature in which a binder phase, containing the iron group metal and the specific metal element as main components, exists as a liquid phase. When the sintering temperature is lower than 1250° C., the rate at which the specific metal element is made compositionally even is so low that sintering is only insufficiently effected, resulting in a decrease in hardness and strength of the sintered alloy. When the sintering temperature exceeds 1550° C., too much evaporation of the specific metal element and the resulting extinction of the specific metal element, as well as abnormal growth of grain at a hard phase, may occur, resulting in a. decrease in hardness.

The step (4) of the method of the present invention is a process in which the sintered alloy having an even or non-graded composition, obtained in the step (3), is made compositionally graded. Specifically, in a temperature range between the temperature at which the powdery mold has been held and heated and the temperature at which the liquid phase begins to solidify, the state of the inactive atmosphere in the step (3) is changed to a state in which the pressure of the inactive atmosphere is no higher than the vapor pressure of the specific metal element (to a high vacuum state, in an actual application), so that the specific element is allowed to evaporate from a surface of the sintered alloy. It is preferable that the temperature at which the state of the inactive atmosphere of the step (3) is changed to another state is adjusted depending on the type of the specific metal element which has been added. Specifically, in the case of Cr, Au, Ge and the like having relatively low vapor pressure, it is preferred that the sintered alloy is held in the inactive atmosphere of the changed state for a predetermined period at the sintering temperature thereof. In the case of Ga, Ag, In, Mn, Pb and the like having relatively high vapor pressure, it is preferred that the sintered alloy is held in the inactive atmosphere of the changed state for a predetermined period at the temperature at which the liquid phase begins to solidify.

In the step (4) of the method of the present invention, it suffices if the pressure of the inactive atmosphere is no higher than the vapor pressure of the specific metal element. However, it is preferred that the changed pressure of the inactive atmosphere is approximately one-tenth of the vapor pressure of the specific metal element. Further, in the step (4), setting the pressure of the inactive atmosphere so as to be no higher than the vapor pressure of the iron group metal is preferable because then evaporation of the iron group metal occurs and the compositional grading of the present invention is thereby facilitated. In a case in which two or more types of the specific metal elements are added to the alloy, the average of the vapor pressures of these specific metal elements is used as "the vapor pressure of the specific metal element". It is preferable that a combination of specific metal elements, of which vapor pressures extremely differ from each other, is avoided.

In the compositionally graded sintered alloy of the present invention, the specific metal element which has been added evaporates from a surface of the sintered alloy at the time of sintering, causing an effect of facilitating the compositional grading of the present invention. Further, the specific metal element facilitates evaporation of the iron group metal, causing an effect of further facilitating the compositional grading of the present invention. The decreased contents of the specific metal element and the iron group metal in the vicinity of a surface of the sintered alloy brings an effect of providing hardness and toughness (wear resistance and breaking resistance) simultaneously in a region in the vicinity of the alloy surface. The specific metal element remaining in an inner portion of the sintered alloy brings an effect of strengthening the binder phase of the iron group metal. The compositional grading appropriately effected between the vicinity of the alloy surface and an inner portion thereof brings an effect of improving the characteristics of the alloy as a whole and thus significantly improving performance of the alloy in use.

EXAMPLE 1

Powders of commercially available WC having average particle diameter of 0.5 μm (which will be referred to as "WC/F" hereinafter), WC having average particle diameter of 2.1 μm (which will be referred to as "WC/M" hereinafter), carbon black having average particle diameter of 0.02 μm (which will be referred to as "C" hereinafter), W having average particle diameter of 0.5 μm, TaC having average particle diameter of 1.0 μm, (W, Ti, Ta)C having average particle diameter of 1.1 μm (the weight ratio thereof: WC/TiC/TaC=50/30/20), TiN having average particle diameter of 1.2 μm, $Mo_2C$ having average particle diameter of 1.7 μm, Co having average particle diameter of 1.0 μm, Ni having average particle diameter of 1.7 μm, Fe having average particle diameter of 1.5 μm, $Cr_3C_2$ having average particle diameter of 2.3 μm (the content of Cr therein is 86% by weight), Ge (−325#), Cu, Sn, $Ni_3Al$ (the content of Al therein is 13.3% by weight), Ag, $In_2O_3$ (the content of In therein is 82% by weight), and Mn were prepared and each scaled, to obtain the blend compositions as shown in Table 1. Each of the mixed powders having the blend compositions, acetone as a solvent and a ball made of cemented carbide were placed in a pot made of stainless steel. The mixture was mixed and pulverized in the pot for 48 hours and dried, whereby mixed powder was obtained. In the present example, the amount of carbon to be blended was adjusted by addition of C or W such that a medium carbon alloy (a carbon alloy plotted at the medium of the range of the sound phase region, which alloy is free from deposit of free carbon, $Co_3W_3C$, $Ni_2W_4C$, $Fe_3W_3C$ and the like) was produced after sintering. Thereafter, the mixed powder was charged in a mold, and a compressed-green compact of 5.3×10.5×31 mm was produced at a pressure of 196 MPa. The resulting compressed-green compact was placed on a carbon plate coated with carbon black powder, and then inserted into a sintering furnace to be heated and sintered, whereby each of the cemented carbides corresponding to present products 1 to 15 of the present invention and comparative products 1 to 15 was obtained. Details of the condition of the atmosphere during each of the temperature-increasing process, the sintering process and the cooling process applied to the production of the aforementioned samples are shown in Table 2. Table 2 assigns a number to each condition of the atmosphere. Table 1 shows the condition number which represents the condition of the atmosphere, the temperature and the time applied in the production of each example.

TABLE 2

| Condition No. | Atmosphere and temperature range: At the time of raising temperature* | At the time of sintering | At the time of cooling** |
|---|---|---|---|
| 1 | 100 Pa Ar from 1300° C. | 100 Pa Ar | Cooled by maintaining in 0.1 Pa vacuum for 5 min |
| 2 | 100 Pa Ar from 1300° C. | 100 Pa Ar | Cooled by maintaining in 0.1 Pa vacuum for 1 min |
| 3 | 100 Pa Ar from 1300° C. | 100 Pa Ar | 0.1 Pa vacuum |
| 4 | 1kPa Ar from 1200° C. | 100 Pa Ar | 1 Pa vacuum |
| 5 | 0.1 MPa Ar from 1000° C. | 0.1 MPa Ar | Cooled by maintaining in 1 Pa vacuum at 1350° C. for 10 min |
| 6 | 100 Pa Ar + 20% $N_2$ from 1300° C. | 100 Pa Ar + 20% $N_2$ | 0.1 Pa vacuum |
| 7 | 5 Pa vacuum | 3 Pa vacuum | 1 Pa vacuum |
| 8 | 1 kPa Ar from 1300° C. | 1 kPa Ar | 1 kPa Ar |
| 9 | 0.1 MPa Ar from 1000° C. | 0.1 MPa Ar | 0.1 MPa Ar |

TABLE 1

| Sample No. | | Formulated composition (% by weight) | Sintering condition (° C.-min) | No. of Condition of atmosphere |
|---|---|---|---|---|
| Present product | 1 | 97.0WC/F—2.0Co—1.0$Cr_3C_2$ | 1500-35 | Condition 1 |
| | 2 | 91.7WC/M—8.0Co—0.3$Cr_3C_2$ | 1420-35 | Condition 1 |
| | 3 | 90.0WC/M—8.0Co—2.0$Cr_3C_2$ | 1420-35 | Condition 1 |
| | 4 | 81.0WC/M—3.0W—8.0Co—8.0$Cr_3C_2$ | 1420-39 | Condition 2 |
| | 5 | 89.0WC/M—2.0W—8.0Ni—1.0Ge | 1420-35 | Condition 1 |
| | 6 | 89.0WC/M—2.0TaC—8.0Co—1.0Cu | 1400-39 | Condition 2 |
| | 7 | 89.0WC/M—8.0Co—2.0Cu—1.0Sn | 1400-39 | Condition 2 |
| | 8 | 91.0WC/M—8.0Co—1.0Sn | 1400-39 | Condition 2 |
| | 9 | 91.0WC/M—4.0Ni—5.0$Ni_3Al$ | 1440-35 | Condition 1 |
| | 10 | 91.0WC/M—8.0Co—1.0Ag | 1400-40 | Condition 4 |
| | 11 | 89.6WC/M—0.4C—8.0Co—2.0$In_2O_3$ | 1400-40 | Condition 5 |
| | 12 | 88.7WC/M—0.3C—1.0$Mo_2C$—7.0Fe—1.0Ni—2.0Mn | 1420-40 | Condition 5 |
| | 13 | 87.0WC/M—2.0(W,Ti,Ta)C—1.0TiN—5.0Co—5.0$Ni_3Al$ | 1440-40 | Condition 6 |
| | 14 | 0WC/F—32.0(W,Ti,Ta)C—25.0Co—8.0$Cr_3C_2$ | 1380-39 | Condition 2 |
| | 15 | 87.7WC/M—0.3C—8.0Fe—1.0$Cr_3C_{2—1.0Cu—1.0Mn}$ | 1420-40 | Condition 3 |
| Comparative product | 1 | Same as Present product 1 | 1500-40 | Condition 7 |
| | 2 | Same as Present product 2 | 1420-40 | Condition 7 |
| | 3 | Same as Present product 3 | 1420-40 | Condition 7 |
| | 4 | Same as Present product 4 | 1420-40 | Condition 7 |
| | 5 | Same as Present product 5 | 1420-40 | Condition 7 |
| | 6 | Same as Present product 6 | 1400-40 | Condition 7 |
| | 7 | Same as Present product 7 | 1400-40 | Condition 7 |
| | 8 | Same as Present product 8 | 1400-40 | Condition 7 |
| | 9 | Same as Present product 9 | 1440-40 | Condition 7 |
| | 10 | Same as Present product 10 | 1400-40 | Condition 8 |
| | 11 | Same as Present product 11 | 1400-40 | Condition 8 |
| | 12 | Same as Present product 12 | 1420-40 | Condition 9 |
| | 13 | Same as Present product 13 | 1440-40 | Condition 7 |
| | 14 | Same as Present product 14 | 1380-40 | Condition 8 |
| | 15 | Same as Present product 15 | 1420-40 | Condition 7 |

TABLE 2-continued

| Condition No. | Atmosphere and temperature range: At the time of raising temperature* | At the time of sintering | At the time of cooling** |
|---|---|---|---|

Note)

*Each of the atmospheres was remained vacuum of approximately 5 Pa until the temperature thereof reached a predetermined temperature. In each of the atmospheres, when the temperature thereof was 1000° C. or higher, the rate at which the temperature increased was set approximately 15° C./min.

**In each of the atmospheres, when the temperature thereof was 1000° C. or higher, the rate at which the temperature dropped was set approximately 10° C./min.

Each of the sample pieces of the cemented carbides obtained as described above (approximately 4.3×8.5×25 mm) was subjected to wet grinding by a diamond grindstone of #230 so as to have a shape of 4.0×8.0×25.0 mm. In this wet grinding process, the ground depth (i.e., the distance between the original surface and the finished ground surface of the sintered body) of one of the two surfaces each having dimension of 4.0×25 mm (which one surface will be referred to as "the surface A" hereinafter) was set at 0.1 mm. Thereafter, each sample piece was set in a device such that a tensile stress was applied onto the surface A and the transverse-rupture strength (hereinafter abbreviated to as "TRS") was measured according to JIS prescription. Further, after the surface A was subjected to lapping with diamond paste in which the particle diameter was 1 μm, hardness and fracture toughness values KIC (the IF method) was measured under a load of 294 N using a Vickers indentator. The results of these measurements are shown in Table 3. From these results, it is understood, when the present product pieces according to the present invention which were sintered in a controlled atmosphere are compared with the comparative product pieces which employed mixed powders of the same compositions as the present products but were sintered by the conventional method, that: the TRS of each of the present product pieces is approximately 200 to 500 MPa higher than the deflecting force of each of the comparative product pieces; hardness and fracture toughness of the former (the present ones) are equal to or higher than those of the latter (the comparative ones), respectively; and at least one of hardness and fracture toughness of the former is significantly higher than that of the latter.

TABLE 3

| Sample No. | | TRS (MPa) | Hardness (HV) | Fracture toughness (MPa · $m^{1/2}$) |
|---|---|---|---|---|
| Present product | 1 | 1770 | 2020 | 9.1 |
| | 2 | 3220 | 1650 | 12.2 |
| | 3 | 3440 | 1680 | 14.6 |
| | 4 | 2890 | 1630 | 15.2 |
| | 5 | 2910 | 1510 | 15.4 |
| | 6 | 3420 | 1620 | 14.5 |
| | 7 | 3650 | 1640 | 15.6 |
| | 8 | 3360 | 1650 | 11.6 |
| | 9 | 2450 | 1590 | 12.1 |
| | 10 | 3390 | 1630 | 14.5 |
| | 11 | 3140 | 1650 | 13.2 |
| | 12 | 2890 | 1600 | 15.9 |
| | 13 | 2970 | 1570 | 11.2 |
| | 14 | 2530 | 1410 | 19.8 |
| | 15 | 3030 | 1700 | 14.1 |
| Comparative product | 1 | 1320 | 1920 | 6.1 |
| | 2 | 2920 | 1600 | 11.2 |
| | 3 | 3280 | 1610 | 11.8 |
| | 4 | 2080 | 1590 | 12.2 |
| | 5 | 2190 | 1450 | 13.5 |
| | 6 | 3090 | 1580 | 12.1 |
| | 7 | 2750 | 1540 | 13.5 |
| | 8 | 2910 | 1600 | 10.4 |
| | 9 | 1670 | 1530 | 11.1 |
| | 10 | 3040 | 1590 | 12.6 |
| | 11 | 2420 | 1600 | 11.7 |
| | 12 | 2000 | 1540 | 11.4 |
| | 13 | 2780 | 1550 | 10.2 |
| | 14 | 2430 | 1300 | 18.5 |
| | 15 | 2270 | 1600 | 9.8 |

Next, each of other sample pieces of the cemented carbides obtained as described above was cut and a section thereof was subjected to grinding and lapping, to produce a sample for the composition analysis. By using a scanning analysis electron microscope, a line analysis (from one surface to the other through the center of the section) of the composition was carried out from an as-sintered surface toward an inner portion. On the basis of the results of this line analysis, for each of the specific metal element and the iron group metal element, the average concentration (Cas, Cbs) thereof in a region between the surface and the position which is 0.1 mm inside the surface, of the sample section, the average concentration (Cai, Cbi) thereof in a region which is at least 1 mm inside from the surface of the sample section, and the average concentration (Ca, Cb) thereof in the alloy as a whole, were obtained. Further, the content of the specific metal element with respect to the iron group metal (Ca/Cb) was calculated from the average concentration of the alloy as a whole. These results are shown in Table 4.

TABLE 4

| Sample No. | | Concentration of specific metal element (% by weight): Surface | Inside | Whole | Concentration of iron group metal (% by weight): Surface | Inside | Whole | Ca/Cs (% by weight) |
|---|---|---|---|---|---|---|---|---|
| Present product | 1 | 0.18Cr | 0.85Cr | 0.80Cr | 1.15Co | 1.93Co | 1.89Co | 42.3 |
| | 2 | 0.14Cr | 0.25Cr | 0.23Cr | 6.89Co | 7.91Co | 7.82Co | 2.9 |
| | 3 | 0.85Cr | 1.74Cr | 1.58Cr | 5.44Co | 8.04Co | 7.65Co | 20.6 |
| | 4 | 2.54Cr | 6.84Cr | 6.14Cr | 7.34Co | 8.3Co | 8.02Co | 76.5 |
| | 5 | 0.24Ge | 0.97Ge | 0.83Ge | 5.66Ni | 7.98Ni | 7.79Ni | 10.7 |

TABLE 4-continued

| Sample No. | | Concentration of specific metal element (% by weight) Surface | Inside | Whole | Concentration of iron group metal (% by weight) Surface | Inside | Whole | Ca/Cs (% by weight) |
|---|---|---|---|---|---|---|---|---|
| | 6 | 0.37Cu | 1.02Cu | 0.95Cu | 7.56Co | 7.92Co | 7.86Co | 12.1 |
| | 7 | 0.88Cu | 1.98Cu | 1.76Cu | 7.64Co | 7.89Co | 7.87Co | 31.9 |
| | | 0.13Sn | 0.95Sn | 0.75Sn | | | | |
| | 8 | 0.22Sn | 0.98Sn | 0.90Sn | 7.85Co | 7.98Co | 7.91Co | 11.4 |
| | 9 | 0.12Al | 0.66Al | 0.58Al | 4.73Ni | 9.24Ni | 8.94Ni | 6.5 |
| | 10 | 0.21Ag | 0.91Ag | 0.76Ag | 7.92Co | 8.05Co | 8.00Co | 9.5 |
| | 11 | 0.31In | 1.54In | 1.43In | 8.10Co | 8.11Co | 8.09Co | 17.7 |
| | 12 | 0.14Mn | 1.89Mn | 1.82Mn | 7.00Fe | 7.09Fe | 7.05Fe | 22.6 |
| | | | | | 0.97Ni | 1.05Ni | 1.01Ni | |
| | 13 | 0.30Al | 0.53Al | 0.50Al | 3.28Co | 4.87Co | 4.49Co | 5.7 |
| | | | | | 3.02Ni | 4.42Ni | 4.33Ni | |
| | 14 | 3.67Cr | 6.74Cr | 6.64Cr | 20.31Co | 25.58Co | 24.45Co | 27.2 |
| | 15 | 0.67Cr | 0.84Cr | 0.81Cr | 6.44Fe | 8.22Fe | 8.05Fe | 30.7 |
| | | 0.22Cu | 0.95Cu | 0.86Cu | | | | |
| | | 0.13Mn | 0.87Mn | 0.80Mn | | | | |
| Comparative product | 1 | 0.84Cr | 0.87Cr | 0.87Cr | 2.10Co | 2.03Co | 2.00Co | 43.5 |
| | 2 | 0.24Cr | 0.27Cr | 0.26Cr | 7.88Co | 7.96Co | 7.92Co | 3.3 |
| | 3 | 1.65Cr | 1.71Cr | 1.72Cr | 7.90Co | 8.07Co | 7.98Co | 21.6 |
| | 4 | 6.65Cr | 6.89Cr | 6.80Cr | 8.06Co | 8.05Co | 8.03Co | 84.7 |
| | 5 | 0.99Ge | 1.02Ge | 1.00Ge | 8.01Ni | 8.03Ni | 8.01Ni | 12.5 |
| | 6 | 0.42Cu | 0.52Cu | 0.48Cu | 7.76Co | 8.10Co | 8.08Co | 5.9 |
| | 7 | 0.88Cu | 1.03Cu | 0.95Cu | 8.04Co | 8.24Co | 8.17Co | 15.7 |
| | | 0.29Sn | 0.35Sn | 0.33Sn | | | | |
| | 8 | 0.25Sn | 0.30Sn | 0.28Sn | 8.00Co | 8.06Co | 8.02Co | 3.5 |
| | 9 | 0.70Al | 0.64Al | 0.65Al | 9.54Ni | 9.29Ni | 9.34Ni | 7.0 |
| | 10 | 0.96Ag | 0.99Ag | 0.98Ag | 7.92Co | 7.95Co | 7.95Co | 12.3 |
| | 11 | 1.49In | 1.59In | 1.57In | 7.87Co | 8.00Co | 7.95Co | 19.7 |
| | 12 | 1.78Mn | 1.95Mn | 1.92Mn | 7.05Fe | 7.01Fe | 7.01Fe | 24.0 |
| | | | | | 0.97Ni | 0.97Ni | 0.98Ni | |
| | 13 | 0.50Al | 0.54Al | 0.53Al | 4.98Co | 4.87Co | 4.89Co | 5.7 |
| | | | | | 4.36Ni | 4.32Ni | 4.33Ni | |
| | 14 | 6.67Cr | 6.80Cr | 6.74Cr | 25.03Co | 25.11Co | 25.10Co | 26.9 |
| | 15 | 0.87Cr | 0.87Cr | 0.88Cr | 8.05Fe | 8.13Fe | 8.11Fe | 18.5 |
| | | | | | 0.42Cu | 0.48Cu | | |
| | | | | | 0.14Mn | 0.18Mn | 0.16Mn | |

On the basis of the measurement values shown in Table 4, the concentration ratios (Cai/Cas and Cbi/Cbs) were calculated for the specific metal element and the iron group metal, respectively. Further, the dissipation amount caused by sintering (the sum of evaporation of the specific metal element and that of the iron group metal) was calculated as a difference between the weight at the time of blending and the analysis result shown in Table 4. Note that a decrease in weight thereof due to a reason other than evaporation caused by sintering (e.g., oxygen contained in the mixed powder, volatile components and the like) is not considered. The calculation results obtained as described above are shown in Table 5. From these results, it has been confirmed the following features.

(1) Any of the present products according to the present invention satisfies the formula Cai/Cas≧1.3 (in present product 15 in which a composite was added, only Mn satisfies the aforementioned formula). Accordingly, even when mixed powder of the same composition as that of the comparative product is used, the compositional grading of the present products can be effected in a satisfactory manner by sintering in a controlled atmosphere.

(2) Regarding Cbi/Cbs, the Cbi/Cbs ratios observed in the present products in which the state of the atmosphere had been changed to a high vacuum state at the latter half stage of the held-and-sintered period satisfy the formula Cbi/Cbs≧1.1. In contrast, all of the Cbi/Cbs ratios observed in the comparative products are close to 1.0.

(3) The dissipation amount observed in the present products is generally larger than that observed in the comparative products. Comparative products 7 and 15 each show a relatively large dissipation amount, probably because sintering was carried out in vacuum in spite that Cu, Sn and Mn each having a high vapor pressure had been added therein.

TABLE 5

(% by weight)

| Sample No. | | Concentration ratio of specific metal element (Cai/Cas) | Concentration ratio of iron group metal (Cbi/Cbs) | Calculated value of dissipation amount |
|---|---|---|---|---|
| Present product | 1 | Cr = 4.72 | Co = 1.68 | 5.9 |
| | 2 | Cr = 1.78 | Co = 1.14 | 2.5 |
| | 3 | Cr = 2.05 | Co = 1.48 | 5.0 |
| | 4 | Cr = 2.69 | Co = 1.11 | 4.8 |
| | 5 | Ge = 4.04 | Ni = 1.39 | 4.2 |
| | 6 | Cu = 2.76 | Co = 0.93 | 2.1 |
| | 7 | Cu = 2.25, Sn = 7.31 | Co = 1.03 | 5.6 |
| | 8 | Sn = 4.45 | Co = 1.02 | 2.1 |
| | 9 | Al = 5.5 | Ni = 1.95 | −0.6 |
| | 10 | Ag = 4.33 | Co = 1.02 | 2.6 |
| | 11 | In = 4.97 | Co = 1.00 | 1.2 |
| | 12 | Mn = 13.5 | Fe = 1.10, Ni = 1.08 | 1.2 |
| | 13 | Al = 1.77 | Co = 1.48, Ni = 1.46 | 6.8 |
| | 14 | Cr = 1.84 | Co = 1.26 | 5.7 |
| | 15 | Cr = 1.25, Cu = 4.32, Mn = 1.09 | Fe = 1.28 | 3.1 |

TABLE 5-continued

| Sample No. | | Concentration ratio of specific metal element (Cai/Cas) | Concentration ratio of iron group metal (Cbi/Cbs) | (% by weight) Calculated value of dissipation amount |
|---|---|---|---|---|
| Comparative product | 1 | Cr = 1.04 | Co = 0.97 | −0.3 |
| | 2 | Cr = 1.13 | Co = 1.01 | 0.9 |
| | 3 | Cr = 1.04 | Co = 1.02 | 0.2 |
| | 4 | Cr = 1.04 | Co = 0.99 | 0.3 |
| | 5 | Ge = 1.03 | Ni = 1.00 | −0.1 |
| | 6 | Cu = 1.23 | Co = 1.04 | 4.9 |
| | 7 | Cu = 1.17, Sn = 1.20 | Co = 1.02 | 14.1 |
| | 8 | Sn = 1.21 | Co = 1.01 | 7.7 |
| | 9 | Al = 0.91 | Ni = 0.97 | 0.1 |
| | 10 | Ag = 1.02 | Co = 1.00 | 0.8 |
| | 11 | In = 1.07 | Co = 1.02 | 1.2 |
| | 12 | Mn = 1.10 | Fe = 0.99, Ni = 1.00 | 0.9 |
| | 13 | Al = 1.09 | Co = 0.98, Ni = 0.99 | 2.5 |
| | 14 | Cr = 1.02 | Co = 1.00 | 0.1 |
| | 15 | Cr = 1.00, Cu = 1.14, Mn = 1.28 | Fe = 1.01 | 11.5 |

EXAMPLE 2

Powders of WC/M, TaC, $Mo_2C$, Co, Ni, Fe, Cu, $Ni_3Al$, Ag and Mn as used in Example 1, TaC having average particle diameter of 1.3 μm, and Ti(C, N) having average particle diameter of 1.3 μm (the weight ratio thereof: TiC/TiN=50/50), were each scaled and then combined, to obtain the blend compositions as shown in Table 6. Each of the blend compositions was subjected to mixing, pressure-molding and sintering in a manner and conditions similar to those of example 1, whereby cermets as present products 16 to 20 of the present invention and cermets as comparative examples 16 and 20 were obtained. The conditions of atmosphere employed during the sintering process of example 2 were the same as those of example 1 summarized in Table 2. Table 6 shows the sintering conditions (° C.-min) and the condition numbers (refer to Table 2) employed in the production of each of the samples.

TABLE 6

| Sample No. | | Formulated composition (% by weight) | Sintering condition (° C.-min) | No. of Condition of atmosphere |
|---|---|---|---|---|
| Present product | 16 | 70.0TiC—10.0$Mo_2C$—15.0Ni—5.0Cu | 1420-39 | Condition 2 |
| | 17 | 50.0TiC—10.0WC/M—30.0Fe—10.0Mn | 1380-40 | Condition 5 |
| | 18 | 40.0TiC—20.0Ti(C,N)—10.0WC/M—10.0TaC—5.0$Mo_2C$—9.0Ni—6.0$Ni_3Al$ | 1420-40 | Conciition 6 |
| | 19 | 34.0TiC—20.0Ti(C,N)—10.0WC/M—10.0TaC—5.0$Mo_2C$—7.0Ni—7.0Co—5.0Ag | 1420-40 | Condition 6 |
| | 20 | 56.0Ti(C,N)—10.0WC/M—10.0TaC—5.0$Mo_2C$—7.0Ni—7.0Co—5.0Mn | 1480-40 | Condition 6 |
| Comparative product | 16 | Same as Present product 16 | 1420-40 | Condition 7 |
| | 17 | Same as Present product 17 | 1380-40 | Condition 8 |
| | 18 | Same as Present product 18 | 1420-40 | Condition 7 |
| | 19 | Same as Present product 19 | 1420-40 | Condition 8 |
| | 20 | Same as Present product 20 | 1480-40 | Condition 9 |

For each of the test pieces of cermets obtained as described above, the TRS, hardness and fracture toughness thereof were measured, respectively, in a manner similar to that of example 1. The results are shown in Table 7. From the results shown in Table 7, it is understood that the present products produced according to the present invention exhibit significantly better measurement values than the comparative products, as is the case with the cemented carbide of example 1.

TABLE 7

| Sample No. | | TRS (MPa) | Hardness (HV) | Fracture toughness (MPa · $m^{1/2}$) |
|---|---|---|---|---|
| Present product | 16 | 1630 | 1820 | 7.6 |
| | 17 | 1930 | 1450 | 8.7 |
| | 18 | 1810 | 1790 | 9.2 |
| | 19 | 2020 | 1730 | 9.4 |
| | 20 | 2010 | 1810 | 9.4 |
| Comparative product | 16 | 1350 | 1760 | 6.5 |
| | 17 | 1670 | 1400 | 7.6 |
| | 18 | 1530 | 1750 | 8.8 |
| | 19 | 1670 | 1510 | 9.5 |
| | 20 | 1930 | 1590 | 9.4 |

Next, the results of the composition analysis on the samples of example.2 are shown in Table 8. From the results shown in Table 8, it is understood that the compositional grading of the added specific elements is more conspicuously effected in the cermet compositions of the present products than in those of the comparative products.

TABLE 8

| Sample No. | | Specific metal element | | | Iron group metal | | |
|---|---|---|---|---|---|---|---|
| | | Surface concentration (% by weight) | Inside concentration (% by weight) | Concentration ratio (Cai/Cas) | Surface concentration (% by weight) | Inside concentration (% by weight) | Concentration ratio (Cai/Cas) |
| Present product | 16 | 1.03Cu | 4.32Cu | Cu = 4.19 | 13.35Ni | 15.71Ni | Ni = 1.14 |
| | 17 | 4.24Mn | 9.38Mn | Mn = 2.21 | 30.05Fe | 30.23Fe | Fe = 1.00 |
| | 18 | 0.39Al | 0.80Al | Al = 2.05 | 12.02Ni | 14.14Ni | Ni = 1.18 |
| | 19 | 1.14Ag | 4.84Ag | Ag = 4.25 | 6.05Ni | 7.04Ni | Ni = 1.18 |
| | | | | | 6.16Co | 7.12Co | Co = 1.16 |
| | 20 | 0.96Mn | 4.56Mn | Mn = 4.75 | 5.29Ni | 7.13Ni | Ni = 1.35 |
| | | | | | 5.34Co | 7.07Co | Co = 1.32 |
| Comparative product | 16 | 3.62Cu | 4.56Cu | Cu = 1.26 | 14.75Ni | 15.07Ni | Ni = 1.02 |
| | 17 | 8.79Mn | 9.64Mn | Mn = 1.07 | 29.98Fe | 29.81Fe | Fe = 0.99 |
| | 18 | 0.58Al | 0.67Al | Al = 1.16 | 14.09Ni | 14.18Ni | Ni = 1.01 |
| | 19 | 4.57Ag | 4.74Ag | Ag = 1.04 | 7.12Ni | 6.89Ni | Ni = 0.97 |
| | | | | | 7.06Co | 6.83Co | Co = 0.96 |
| | 20 | 5.03Mn | 4.92Mn | Mn = 0.98 | 7.22Ni | 6.88Ni | Ni = 0.95 |
| | | | | | 7.16Co | 6.93Co | Co = 0.97 |

The compositionally graded sintered alloy of the present invention has significantly better alloy characteristics than the comparative alloy samples prepared by using mixed powder of the same composition as that of the present invention but sintered in the conventional method, in which alloy characteristics the strength of the former is 10 to 30% higher than that of the latter, both hardness and toughness of the former are substantially equal to or better than those of the latter and at least one of hardness and toughness is 10 to 30% higher than that of the latter. Accordingly, use of the compositionally graded sintered alloy of the present invention, for a surface portion of a cutting edge of a cutting tool or a surface to be subjected to wear of a wear resistant tool, will improve wear resistance and breaking resistance at the same time, whereby a significant improvement in terms of product life of a tool can be achieved.

The invention claimed is:

1. A compositionally graded sintered alloy which comprises: 1 to 40% by weight of an iron group metal; 0.1 to 10% by weight of at least one specific metal element selected from the group consisting of Cr, Au, Ge, Cu, Sn, Al, Ga, Ag, In, Mn and Pb; a hard phase containing, as a main component, at least one compound selected from the group consisting of a carbide, a nitride and a mutual solid solution of a metal (s) which belongs to Group 4 (Ti, Zr, Hf), 5 (V, Nb, Ta) or 6 (Cr, Mo, W) of the Periodic Table; and inevitable impurities, wherein the content of the specific metal element gradually increases from a surface of the sintered alloy toward an inner portion thereof, and a ratio of the average concentration of the specific metal element in a region which is at least 1 mm inside from the surface of the sintered alloy, to the average concentration of the specific metal element in a region between the surface and the position which is 0.1 mm inside the surface, of the sintered alloy, is 1.3 or more.

2. The compositionally graded sintered alloy according to claim 1, wherein the specific metal element is at least one selected from the group consisting of Cr, Al and Mn.

3. The compositionally graded sintered alloy according to claim 1, wherein the specific metal element is at least one selected from the group consisting of Au, Cu and Ag.

4. The compositionally graded sintered alloy according to claim 1, wherein the specific metal element is at least one selected from the group consisting of Ge, Sn, Ga, In and Pb.

5. The compositionally graded sintered alloy according to claim 1, wherein the ratio of the average concentration of the specific metal element in a region which is at least 1 mm inside from the surface of the sintered alloy, to the average concentration of the specific metal element in a region between the surface and the position which is 0.1 mm inside the surface, of the sintered alloy is 2 to 20.

6. The compositionally graded sintered alloy according to claim 1, wherein the content of the iron group metal gradually increases from a surface of the sintered alloy toward an inner portion thereof, and a ratio of the average concentration of the iron group metal in a region which is at least 1 mm inside from the surface of the sintered alloy, to the average concentration of the iron group metal in a region between the surface and the position which is 0.1 mm inside the surface, of the sintered alloy, is 1.1 or more.

7. The compositionally graded sintered alloy according to claim 1, wherein the content of the specific metal element is 5 to 50% by weight based on the content of the iron group metal.

8. The compositionally graded sintered alloy according to claim 1, wherein the hard phase comprises tungsten carbide, or tungsten carbide and a cubic system compound comprising at least one of compound selected from a carbide, a nitride and a mutual solid solution of a metal(s) which belongs to Group 4, 5 or 6 of the Periodic Table.

9. The compositionally graded sintered alloy according to claim 1, wherein the hard phase comprises 30% by weight or more of at least one selected from the group consisting of a carbide, a nitride and a carbonitride of titanium, and the reminder being at least one selected from the group consisting of a carbide, a nitride and a carbonitride of a metal which belongs to Group 4, 5 or 6 of the Periodic Table, provided that titanium is excluded.

* * * * *